United States Patent [19]

Ebbing et al.

[11] Patent Number: 5,007,499

[45] Date of Patent: Apr. 16, 1991

[54] SILENCER FOR A CENTRIFUGAL COMPRESSOR

[75] Inventors: Charles E. Ebbing, Fayetteville; Donald G. Neville, Syracuse, both of N.Y.

[73] Assignee: Carrier Corporation, Syracuse, N.Y.

[21] Appl. No.: 483,618

[22] Filed: Feb. 23, 1990

[51] Int. Cl.[5] ..... F01N 1/24

[52] U.S. Cl. ..... 181/258; 181/227; 181/252; 181/296

[58] Field of Search ..... 181/227, 231, 244, 252, 181/256, 258, 268, 240, 228, 269, 296; 55/DIG. 30, 31; 138/37, 39

[56] References Cited

U.S. PATENT DOCUMENTS

| | | | |
|---|---|---|---|
| 1,575,657 | 3/1926 | Straussler | 181/258 |
| 3,112,007 | 11/1963 | Ludlow et al. | 181/227 |
| 3,117,650 | 1/1964 | Ludlow et al. | 181/227 |
| 3,124,930 | 3/1964 | Powers | 55/DIG. 20 X |
| 3,676,012 | 7/1972 | Boockie | 181/227 X |
| 3,677,764 | 7/1972 | Pawlina | 181/269 |
| 3,798,769 | 3/1974 | Bailey | 181/240 |
| 4,370,855 | 2/1983 | Tuggle | 181/240 |
| 4,518,402 | 5/1985 | Bargel | 55/DIG. 31 X |
| 4,872,528 | 10/1989 | Goplen et al. | 181/278 |

*Primary Examiner*—Benjamin R. Fuller
*Attorney, Agent, or Firm*—Dana F. Bigelow

[57] ABSTRACT

A silencer device is installed into the discharge pipe of a centrifugal compressor by first installing a channel shaped frame in the discharge pipe and then sliding the silencer device into the frame to be contained for operational use. The orientation and placement of the frame and its contained silencer device is parallel with the direction of flow to thereby reduce the resulting pressure drop, and it is placed near a turn in the discharge pipe such that the sound will tend to be reflected from the discharge pipe to cause multiple passes through the silencer device and thereby enhance its absorptive performance. The absorptive material within the silencer device is protected from erosion by a surrounding cloth bag composed of a fine weave Nomex material.

16 Claims, 5 Drawing Sheets

SILENCER FOR A CENTRIFUGAL COMPRESSOR

BACKGROUND OF THE INVENTION

This invention relates generally to centrifugal compressors and, more particularly, to silencer devices to be located in the discharge pipe of a centrifugal compressor.

Centrifugal compressors, of the type which are used for large air conditioning systems, have a number of included components which create sound and vibration that radiates from the compressor and attached components including the motor, gearing, condenser and evaporator shells and the discharge line. In addition to design considerations that tend to minimize these sounds, it is common practice to reduce the sounds by way of external, surface-applied, lagging materials or the addition of internal discharge line silencers (i.e., an acoustically absorptive material such as fiberglass, mineral fiber, or Dacron) which are placed in the discharge line of the compressor. Such an absorptive material is inherently exposed to the flow of compressed fluid through the compressor and, if not protected, tends to be eroded. For example, fiberglass absorbing material that is commonly used is generally quite brittle, and does not hold up well to the movement that it normally encounters in compressor operation unless it is properly preloaded in compression.

One means of protecting the fiberglass absorbing material from erosion is the use of a protective material on either side thereof to stabilize the absorptive material against movement. For example, a perforated metal may be sandwiched on either side of the fiberglass material for that purpose, and screens and fiberglass cloth structures may also be added. However, it has been found that fiberglass cloth also tends to break down, with its particles then entering the system in an undesirable manner. Further, as the erosion of the fiberglass cloth proceeds, it will eventually allow the movement of compressed fluid through the holes of the perforated material to act directly on the enclosed absorptive material and cause it to erode as well. This problem of erosion is further complicated by the requirement that the material for both the absorptive elements and the protective elements be compatible with the refrigerant and lubricant in which they are necessarily immersed.

The usual approach for installing a silencer device in the discharge pipe of a compressor is by rigidly securing the entire assembly to the inner side walls of the discharge pipe by welding or the like. Because of the relatively small size of the discharge pipe and the desirability for placement of the silencer in axial location within the pipe, the accessibility is severely limited to thereby complicate the process. Further, when welding is performed in close proximity to the absorptive material within the silencer device, as is usually required, the absorptive material may be damaged by the resulting heat.

Rather than installing the silencer device directly into the discharge pipe, another approach is to remove a portion thereof and install a complete replacement section comprising a pipe-like structure with the silencer device installed therein. Such a unit has customarily been attached by way of mating flanges. Such an approach is therefore relatively expensive, involving both extensive expenditures of time and material.

In order to obtain the desired performance characteristics in a silencer device, it has often been found necessary to provide a relatively thick absorptive pad in the discharge line.

So as to not unduly restrict the flow that would otherwise occur from such a thick pad and its protective elements, a bulbous structure is often provided around the silencer device to thereby reduce the pressure drop thereacross. This, of course, adds substantial expense to the system.

One of the known approaches for eliminating erosion is to preload the absorptive material so that it is less susceptible to movement or vibration when exposed to the flow and pressure conditions encountered in normal compressor operation. This preloading of the material may be accomplished by compressing it in the framework of the silencer structure. This has been accomplished, for example, by installing the fiberglass material into the framework and then, after compressing the framework appropriately, permanently maintaining this compressed position by the use of welding, fasteners, or the like. This process can be time consuming and expensive and can easily result in variable degrees of compression in the absorptive material. Further, it makes it difficult, if not impossible, to replace the fiberglass elements without discarding and replacing the entire silencer framework.

It is therefore an object of the present invention to provide an improved centrifugal compressor silencer apparatus and method of installation.

Another object of the present invention is the provision in a centrifugal compressor silencer for reducing erosion of the absorptive element.

Yet another object of the present invention is the provision in a discharge line silencer of a centrifugal compressor for protecting the absorptive material from erosion.

Another object of the present invention is the provision for installing a silencer into a discharge pipe in an easy and efficient manner.

Still another object of the present invention is the provision for installing a silencer into a discharge pipe without risk of damaging the absorptive material wihin the silencer device.

Yet another object of the present invention is the provision for economically installing a silencer device in such a manner as to obtain desired performance characteristics.

These objects and other features and advantages become more readily apparent upon reference to the following description when taken in conjunction with the appended drawings.

SUMMARY OF THE INVENTION

Briefly, in accordance with one aspect of the invention, the sound absorptive fiberglass material is surrounded by a fine weave, non-brittle, cloth material which is fatigue resistant, and which allows the sound waves in the discharge line to pass through both the cloth and the absorptive material while, at the same time, protecting the fiberglass material from direct impingement of the compressed fluid to thereby substantially reduce the erosion thereof.

By another aspect of the invention, a silencer device is installed in the discharge line of a centrifugal compressor by first installing a channel-like frame having an opening near an open end of a section of the discharge pipe. The silencer device is then slid into the frame open end until it is fully contained within, and retained by, the channel-like frame.

By another aspect of the invention, the frame is generally aligned in the direction of flow within the containing portion of the discharge pipe, but is placed near a bend in the discharge pipe such that the sound waves will tend to be reflected from the bend to thereby cause the sound to make multiple passes through the silencer device and thereby enhance its performance.

In the drawings as hereinafter described, a preferred embodiment and modified embodiments are depicted; however, various other modifications and alternate constructions can be made thereto without departing from the true spirit and scope of the invention.

DESCRIPTION OF THE PREFERRED EMBODIMENTS

Figure 1:
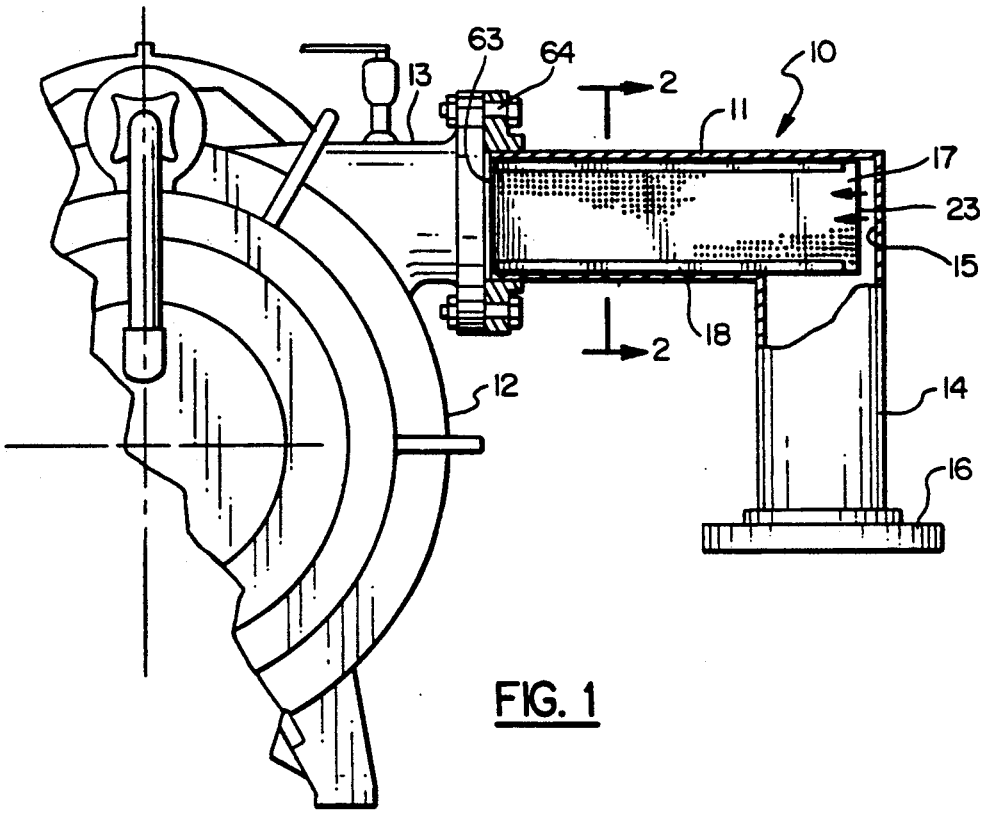
FIG. 1 is a partial sectional view of a centrifugal compressor having the present invention incorporated therein.

Referring now to FIG. 1, the invention is shown generally at 10 as installed in a horizontal discharge pipe 11 of a centrifugal compressor 12, which operates in a conventional manner to compress the refrigerant vapor, and then cause it to flow through the diffuser (not shown) and then into a volute structure 13. The compressed refrigerant vapor then passes from the volute 13 through a horizontal discharge pipe 11, into the vertical discharge pipe 14, and then to a condenser (not shown). The vertical discharge pipe 14 is secured to the condenser by way of a flange 16. The silencer device 17 of the present invention is mounted in the horizontal discharge pipe 11 by way of a frame 18. This can be seen more clearly in FIG. 2.

Figure 2:
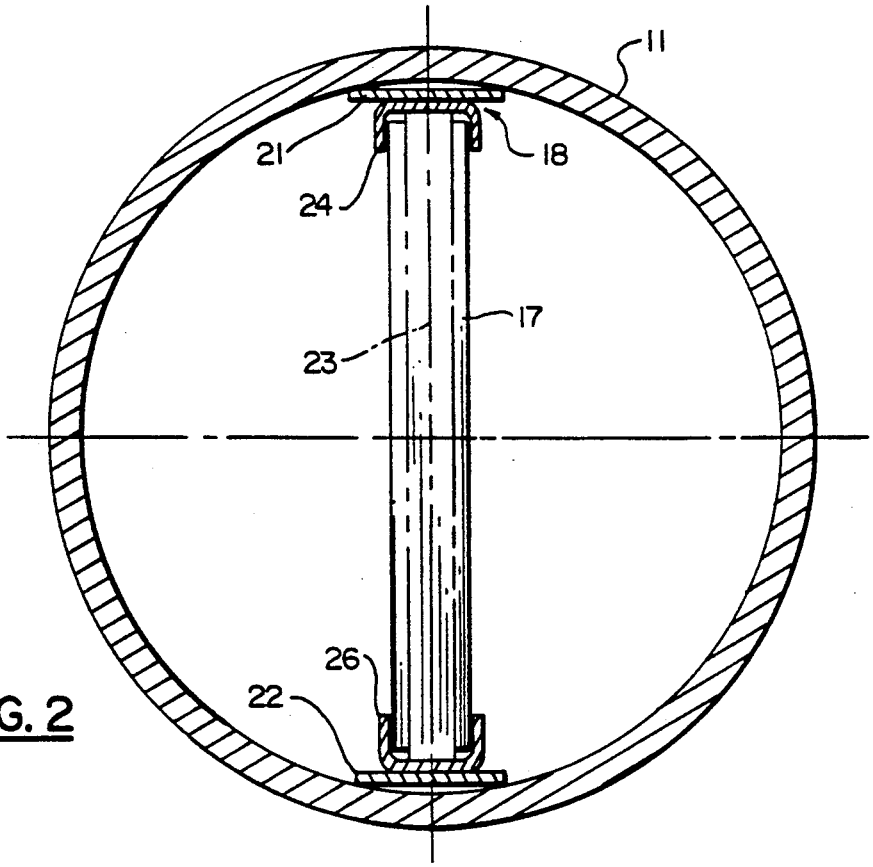
FIG. 2 is a sectional view of the present invention as seen along lines 2—2 of FIg. 1.
Figure 3:
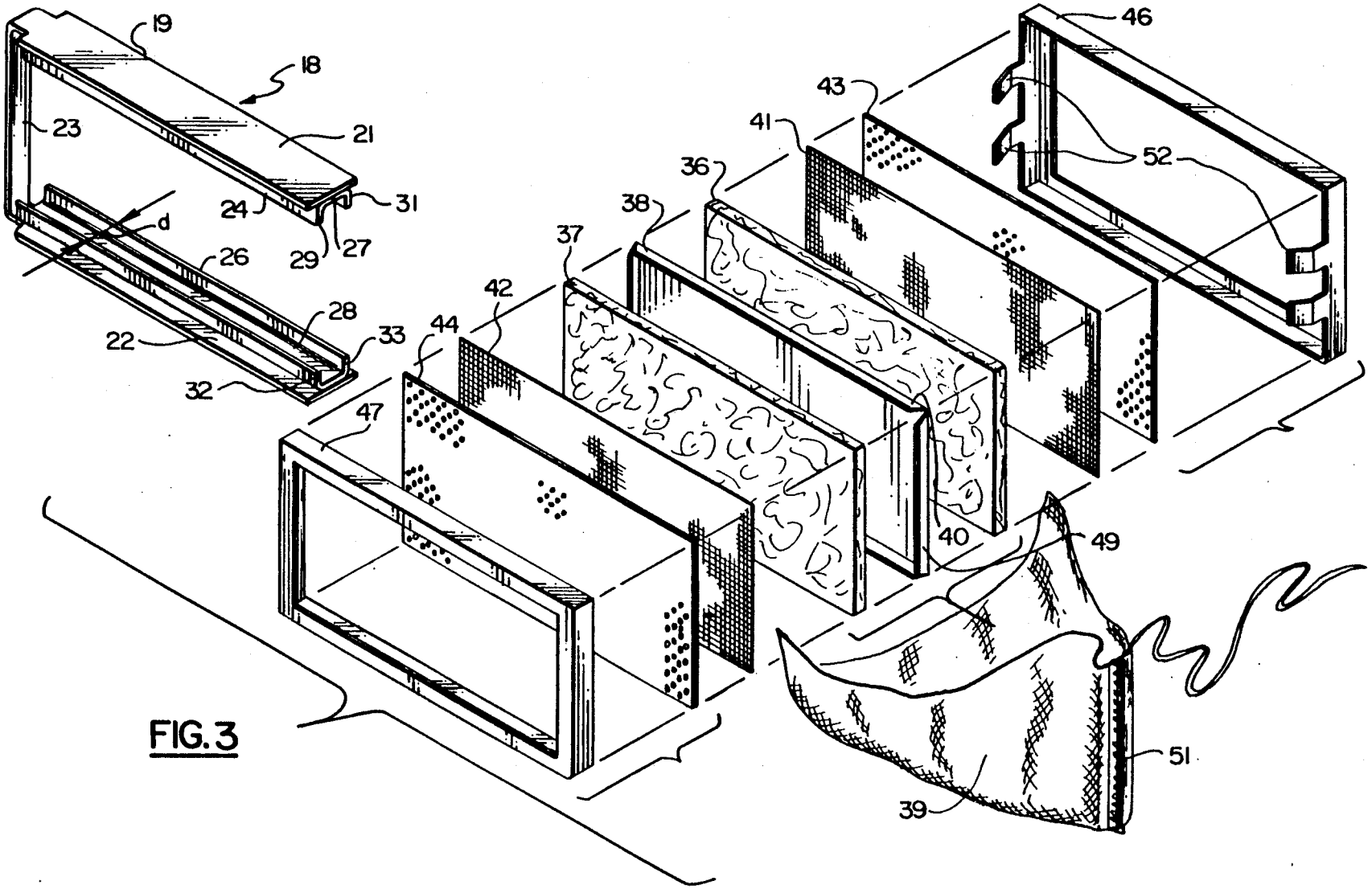
FIG. 3 is an exploded view of the siliencer and frame portion of the present invention.

The frame 18, which is shown installed in FIGS. 1 and 2 and in the uninstalled condition in FIG. 3, includes a U-shaped body comprising side members 21 and 22 and an interconnecting cross-member 23, whose length is substantially equal to the diameter of the horizontal discharge pipe 11. The side members 21 and 22 are axially aligned along the length of the horizontal discharge pipe and are secured, by welding or the like, to the top and bottom internal surfaces of the horizontal discharge pipe as shown in FIG. 2 such that the frame 18 and the silencer device 17 disposed therein is substantially centrally aligned within the horizontal discharge pipe 11.

Also forming part of the frame 18 are a pair of U-shaped channels 24 and 26 having their base sides attached, by welding or the like, to the inner sides of the side members 21 and 22, respectively. Such that the open sides of the U-shaped channels 24 and 26 face inwardly, with their oppositely disposed intermediate members 27 and 28, along with their respective legs 29–31 and 32–33, defining a cavity 34 for receiving the silencer device 17 therein. As shown in FIG. 3, the one end of the U-shaped channels 24 and 26 is open so as to facilitate the insertion of the silencer device 17 in a manner to be described hereinafter. In that regard, it should be mentioned that the lateral distance between the legs 29 and 31, and between the legs 32 and 33, is established at a predetermined dimension so as to obtain the desired degree of precompression of the sound absorptive material in the silencer device 17.

Referring now to FIg. 3, the silencer device 17 is shown in exploded form to include fiberglass pads 36 and 37 with a metal splitter plate 38 therebetween, wire screens 41 and 42, perforated metal sheets 43 and 44, and outer and inner casing members 46 and 47. These elements are all assembled in serial relationship as shown and secured within the casing members 46 and 47 in a relatively uncompressed condition such that they can be stored and shipped for installation into the discharge pipe of a centrifugal compressor, at which time they will be installed in such a manner to be described as to place the fiberglass pads 36 and 37 in a precompressed condition so as to thereby reduce the occurrence of erosion.

Considering now the individual elements in more detail, the fiberglass pads 36 and 37 are the sound absorbing elements of the silencer device 17, with the remaining structure serving primarily as a containment and protective structure for the fiberglass pads 36 and 37. A particular material that has been found suitable is one commercially available as #705 from Owens Corning, with a density of six pounds per cubic foot and a thickness of about ½ inch before being compressed.

The metal splitter plate 38 functions to acoustically separate the silencer device 17 into two separate sound absorbing devices, with each one functioning substantially independent of the other, such that in combination they provide a substantially increased attenuation level as compared with a single unit. A material which has been found suitable for the splitter plate 37 is a 20 gauge sheet metal. Sides 48 and 49 may be provided on the splitter plate 38 for purposes of lateral containment of the fiberglass pads, if desired.

It has been recognized by the applicant's that, even with the protective wire screens and perforated metal sheets, the fiberglass pads 36 and 37 will tend to erode as the high pressure refrigerant vapor passes through the discharge pipe. Accordingly, a protective cloth bag 39 is placed entirely around the combination of the fiberglass pads 36 and 37 and the splitter plate 38. This is accomplished by folding the cloth around the combination and then stitching the three open sides as indicated at the seam 51. A material that has been found suitable for this purpose is a fine weave Nomex cloth which is commercially available as HT-5 from Stern & Stern Textiles, Hornell, NY. This material is not brittle and is fatigue resistant and has been found to stand up well in typical operating conditions.

The screens 41 and 42 are placed in close, abutting relationship to the outer side of the cloth bag 39. A material which has been found suitable for this purpose is a stainless steel (302/304), 0.010 in. diameter wire ×36% free area; 40×40 mesh.

The preferred metal sheets 43 and 44, which are placed in abutting relationship on the outer side of the screens 41 and 42, are preferably made of 20 gauge sheet metal. The perforations are preferably of a diameter of about 0.06 inches on ⅛ inch centers with 22½ perent open area.

The function of the casing members 46 and 47 are simply to contain the above described inner element. The inner casing member 47 has sides that cover the edges of the perforated plates, the screens, and the fiberglass pads, and the outer casing 46 is slightly larger in dimensions so as to allow the inner casing 47 to fit into it in overlapping relationship. A plurality of tabs 52 are provided on the sides of the outer casing member 46 to secure the entire assembly in its installed position by being bent over the edges of the inner casing member 47 as a final step of the assembly process. The result is a silencer device package that is relatively loosely assembled (i.e., with very little, if any precompression of the fiberglass pads 36 and 37) which can be stored and shipped without concern of accidental disassembly. The precompression of the fiberglass pads 36 and 37 is then accomplished when the device is loaded into the compressor frame assembly 18 as will be described hereinafter.

Figure 4:
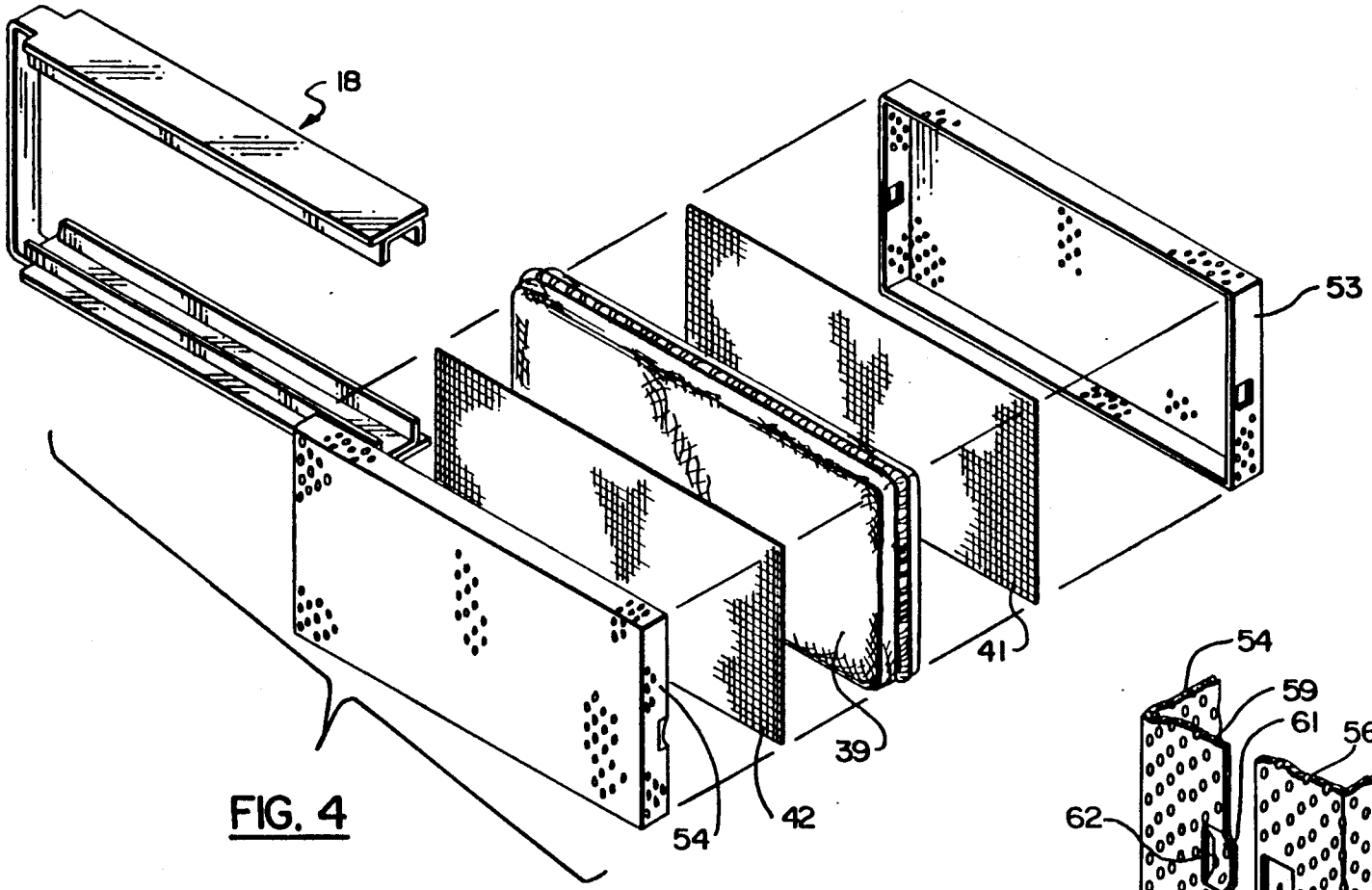
FIG. 4 is a modified embodiment thereof.
Figure 5:
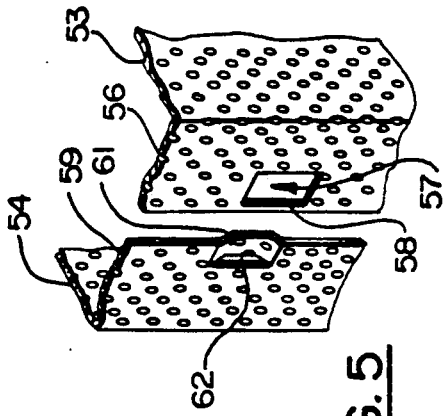
FIG. 5 is an enlarged partial view of the locking portion of the outer casing thereof.

A modified version of the silencer device is shown in FIG. 4 wherein the inner and outer casing 53 and 54 are entirely constructed from perforated metal such that the features of the perforated metal plates 43 and 44 and those of the outer and inner frames 46 and 47 of the FIG. 3 embodiment are combined. This results in a reduced number of parts and a substantial reduction in weight since the relatively heavy outer and inner casings 46 and 47 are replaced with a substantially lighter weight perforated metal material. The securing of the inner and outer casings 53 and 54 is accomplished by incorporation of the features as shown in FIG. 5.

Formed in each of the end sections 56 of the inner casing 53 is a rectangular opening 57 with a remaining rib 58 defining its one side. Formed in corresponding locations of the end sections 59 of the outer casing member 54, is a pair of tabs, one of which is shown at 61 in FIG. 5. These are simply formed by cutting along an edge 62 and then bending the tab 61 inwardly such that when the inner casing 53 is placed into the outer casing member 54, the end sections 5 are temporarily deformed inward to allow tab 61 to slip over the rib 58 and into the opening 57, with the edge 62 then engaging, in a locking relationship with the edge of the rib 58. If disassembly is then required for any reason, the inner casing member and sections 56 can be temporarily deformed inwardly such that the tab 61 becomes disengaged from the rib 58 so as to allow the outer casing member 54 to be removed.

Having described the frame 18 and alternative embodiments of the silencer device 17, the manner in which the fiberglass pads 36 and 37 are precompressed by installation of the silencer device 17 into the frame 18 will now be described. Although the method will refer to the silencer device 17 as shown in FIG. 3, it will be understood that the same process is applicable to the precompression process of the alternative embodiment of the silencer device 17 as shown in FIG. 4.

Figure 6:
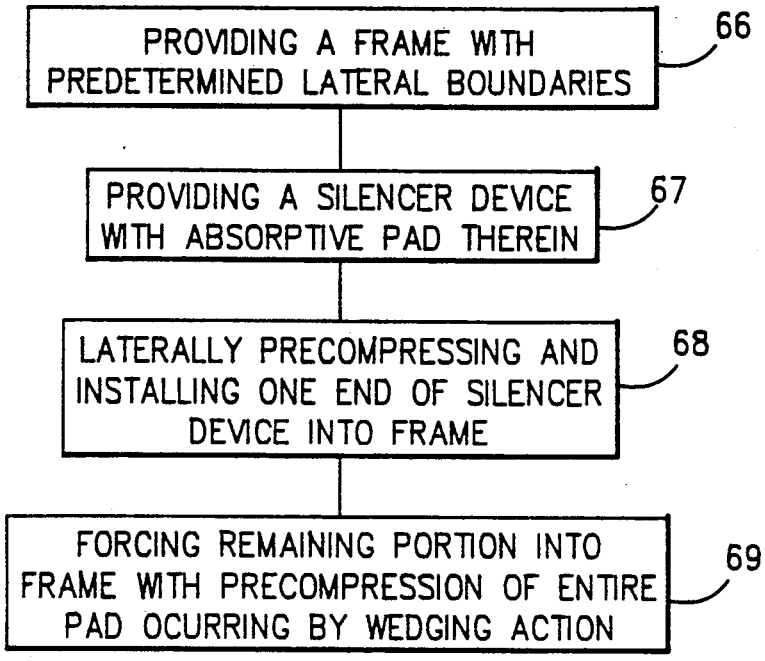
FIG. 6 is a schematic representation of the method of preloading the absorptive material in the silencer apparatus.

In order to install the frame 18 into the horizontal discharge pipe 11 of the compresssor 12 as shown in FIG. 1, the frame is inserted into the one end 63 of the horizontal discharge pipe 11 prior to its being secured to the volute 13 by a plurality of bolts 64. The frame 18 is then aligned with its U-shaped channels 24 and 26 disposed as shown in FIG. 2 such that the cavity 34, as partially defined by the U-shaped channels 27 and 28 has a predetermined lateral dimension "d" as defined by the respective legs 29 and 31 of the U-shaped channel 27 and by legs 32 and 33 of the U-shaped channel 28 as shown in FIG. 3. This dimension "d" is established as being less than the corresponding lateral dimension of the assembled silencer device 17 as measured between the outer faces of the outer and inner casing members 46 and 47. This dimension "d" is also established as a function of the desired lateral dimension of the silencer device 17 such that when the fiberglass pads 36 and 37 are laterally precompressed to a desired degree, the transverse thickness of the silencer device 17 is then substantially equal to that dimension "d". After the frame 18 has been installed to define the boundaries of the cavity 34 as shown in block 66 and FIG. 6, the assembled silencer device 17 is provided (block 67) for insertion into the one end 63 of the horizontal dishcarge pipe 11 and into the cavity 34. Since the lateral thickness of the silencer device 17 when in its relatively unprecompressed state is greater than the dimension "d" of the cavity 34, it is necessary to precompress the silencer device 17 in order to install it into the cavity 34. This is accomplished by precompressing, by hand, one end of the silencer device 17 by squeezing the outer and inner members 46 and 47 together at their one ends to thereby precompress the fiberglass pads 36 and 37 at their one ends. While holding that end in the precompressed state, it is then inserted into the cavity 34, with the legs 29–31 and 32–33 of the U-shaped channels engaging the outer sides of the respective outer and inner frame members 46 nd 47. This is shown at block 63 of FIG. 6. Once the silencer device is started into the cavity 34, it then can then be forced in a wedging manner into the U-shaped channels (block 69), until the silencer device is entirely contained within the cavity 34. In the process, the fiberglass pads 36 and 37 are precompressed, along their entire lengths, to the desired degree of precompression.

That degree of precompression is preferably, for the particular fiberglass material described hereinabove, in the range of 20–30 percent of volume. The fiberglass pads, 36 and 37 will remain in this precompressed condition such that their susceptibility to erosion by a prolonged exposure to high pressure gases resulting from operation of the compressor 12 is substantially reduced.

Having described the structure of the silencer device 17 and the manner of installing it in the discharge pipe 11, the particular placement within the discharge pipe 11 in order to obtain enhanced performance characteristics will now be described.

In this regard, it should be recognized that, while some of the generated sounds will tend to be emitted radially outwardly so as to pass through the walls of the discharge pipe 11, most of the generated sounds is carried by the compressed gases in the system and therefore travels along with the compresssed gas along the axis of the discharge pipe 11. With this in mind, the geometry of the discharge pipe 11 and the particular placement of the silencer device 17 therein, have been selected so as to enhance the sound absorptive characteristics of the system.

Referring to FIG. 1, it will be seen that the discharge pipe 11 has a 90 degree turn therein, and that the silencer device 11 is placed near that turn such that the horizontal component of the sound wave traveling with the fluid will be strongly reflected backwardly from the wall 15 as shown by the arrows to thereby cause it to again pass through the silencer device 17 and to thereby allow further sound to be absorbed. A portion of the sound will then again be carried along with the compressed fluid to again be reflected from the wall 15, with the horizontal component thereof again being reflected back into the silencer device 17. Thus, where the wall 15 is disposed in a substantially normal relationship with the direction of flow, much of the sound will be caused to make multiple passes through the silencer device 17 such that a greater portion thereof will be absorbed than where a single pass is made through the silencer.

Figure 7:
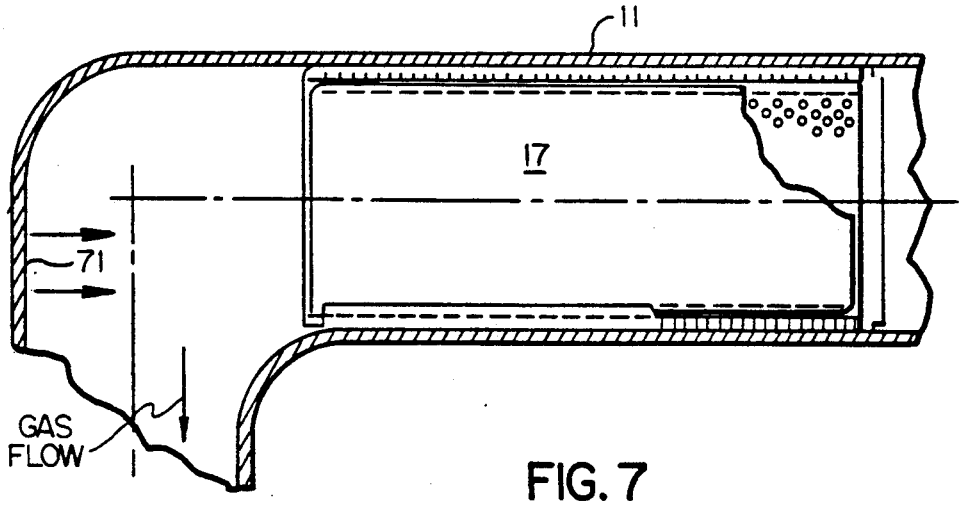
FIGS. 7, 8, and 9 are sectional views of alternative embodiments of the silencer installation in accordance with the present invention.
Figure 8:
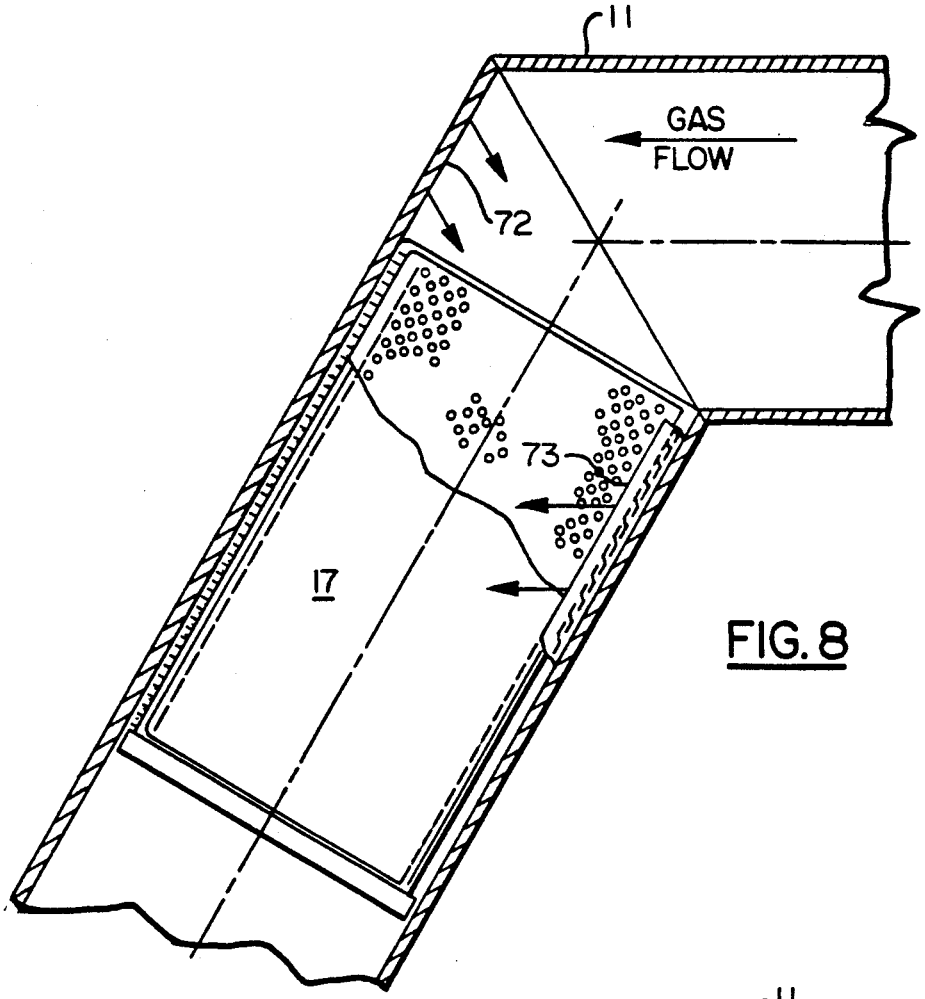
Figure 9:
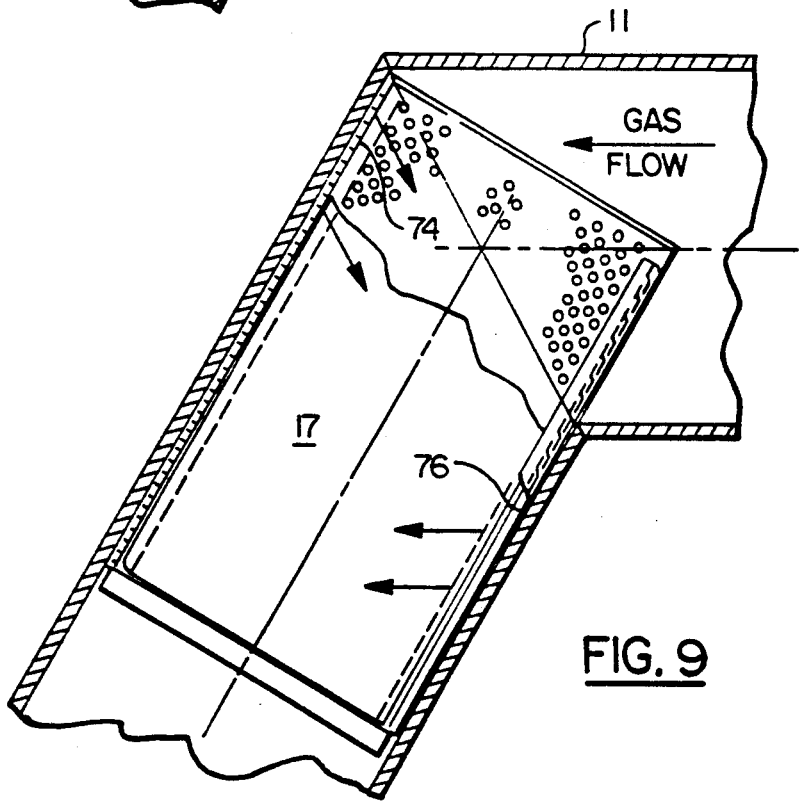

Referring now to FIGS. 7–9, there are shown other possible arrangements for placement of the silencer device 17 within the discharge pipe 11 such that enhanced performance can be obtained by virtue of the fact that some of the sound is reflected back from a surface of the discharge pipe 11. Similar to the FIG. 1 embodiment, the silencer device 17 is placed near a bend in the discharge pipe 11 in all cases. In FIG. 7, for example, a portion 70 of the turn is rounded such that it will not contribute to the multiple paths effect, but another portion 71 is disposed in normal relationship to the silencer device 17 such that the sound will be reflected as shown by the arrows and thereby be caused to again pass through the silencer device 17. Thus, while the reflective action will be somehwat reduced from the FIG. 1 embodiment, the pipe structure will still be effective in reflecting back some of the sound so as to result in enhanced sound aborption.

In the FIG. 8 and 9 embodiments, the silencer device 17 is placed downstream from the bend, and the bend is less than 90 degrees, but the internal surfaces of the discharge pipe 11 will tend to cause reflections of the sound waves such that multiple passes through the silencer device 17 will result. In FIG. 8, the sound waves will strike the wall 72 and pass through the silencer device 17 a first time. The sound waves will then be reflected from the side wall 73 and will pass through the silencer device 17 a second time. The wall 72 will again reflect the sound waves and will cause at least some of them to pass through a portion of the silencer device 17 a third time.

Similarly, in the FIG. 9 embodiment, the sound waves will pass through the silencer device 17 a first time before being reflected from the wall 74. It will then pass through the silencer device a second time and be reflected from the wall 76, after which they will then pass through the silencer device a third time.

While the present invention has been disclosed with particular reference to preferred embodiments thereof, the concepts of this invention are readily adaptable to other embodiments, and those skilled in the art may vary the structure thereof without departing from the essential spirit of the present invention. For example, while the invention has been described in terms of a silencer in the discharge pipe of a centrifugal compressor, it may just as well be employed for use in other areas of other types of compressors. Thus, while other variations will occur to those skilled in the art, it is contemplated that such variations are within the scope of the appended claims.

What is claimed is:

1. An improved silencer device having a sound absorptive material and adapted for placement in a discharge line of a centrifugal compressor comprising:

a sound attenuation frame for mounting in said discharge line of the compressor;

at least one pad of absorptive material installed in said frame, said material being of a brittle nature and thus susceptible, if not protected, of having parts thereof broken off by movement of said material within the discharge line;

a cloth enclosure disposed within said sound attenuation frame and around said at least one pad of material to allow a transmission of sound therethrough but to generally inhibit a direct impingement of a compressed gas on said pad, said cloth enclosure being composed of a fine weave material consisting of fibers which resist brittle fracture/failure; and a metal screen placed adjacent said cloth enclosure and secured within said sound attenuation frame for containing said at least one pad of absorptive material in said cloth enclosure and for further protecting said pad from impingement by compressed fluid thereon.

2. An improved silencer as set forth in claim 1 wherein said cloth is composed of a Nomex material.

3. An improved silencer as set forth in claim 1 wherein said at least one piece of sound absorptive material comprises a pair of spaced elements and further including a metal splitter plate disposed therebetween.

4. An improved silencer as set forth in claim 1 and including a perforated metal sheet adjacent said metal screen.

5. An improved silencer as set forth in claim 1 wherein said at least one piece of sound absorptive material is preloaded by at least 20 percent.

6. An improved silencer device as set forth in claim 1 wherein said at least one piece of sound absorptive material is generally planar in form.

7. An improved silencer device as set forth in claim 1 wherein said metal screen is composed of a fine mesh material.

8. An improved silencer device as set forth in claim 1 wherein said at least one piece of sound absorptive material has a density of at least six pounds per cubic foot.

9. An improved silencer device for placement in a discharge line of a centrifugal compressor comprising:

a sound attenuation frame for mounting in said discharge line;

at least one piece of sound absorptive material disposed in a central portion of said frame;

a fine weave cloth enclosure surrounding said at least one piece of sound absorptive material to protect said material from erosion that would otherwise occur from an impingement of compressed fluid thereon; and a metal screen disposed adjacent said cloth enclosure to provide further protection against erosion of said sound absorptive material.

10. A method of installing in a discharge pipe of a compressor a silencer device having a sound absorbing material enclosed within a fine weave cloth enclosure and metal screen in a container, comprising the steps of:

installing a cavity-defining frame in said discharge pipe, said frame being generally aligned in parallel relationship with an axis of said discharge pipe and said cavity having an open end near an open end of said discharge pipe;

inserting the silencer device through said pipe open end and into said cavity open end; and sliding the silencer device into said cavity to be contained and retained by said frame.

11. A method is set forth in claim 10 wherein said frame installing step is accomplished by welding said frame into the discharge pipe.

12. The method as set forth in claim 10 wherein said frame is u-shaped in cross-section.

13. The method as set forth in claim 10 wherein said frame has structure on one end thereof such that said cavity has a closed end and further wherein the sliding step is concluded when the silencer device engages said structure.

14. A method as set forth in claim 10 wherein the discharge pipe contains a bend and further wherein said frame in installed near said bend such that sound waves traveling within the discharge pipe will be reflected by a portion of said bend to thereby cause multiple passes of the sound waves through said silencer device.

15. A method as set forth in claim 14 wherein said frame is installed between the compressor and said bend.

16. A method as set forth in claim 14 wherein said bend is disposed between the silencer device and the compressor.

* * * * *